US010588473B2

(12) United States Patent
Ni

(10) Patent No.: US 10,588,473 B2
(45) Date of Patent: Mar. 17, 2020

(54) ROD HANDHELD TWO-IN-ONE SPLIT-TYPE VACUUM CLEANER HAVING INDEPENDENT DUST-AIR SEPARATION AND DUST STORAGE DEVICE

(71) Applicant: KINGCLEAN ELECTRIC CO., LTD., Suzhou, Jiangsu (CN)

(72) Inventor: Zugen Ni, Jiangsu (CN)

(73) Assignee: KINGCLEAN ELECTRIC CO., LTD., Suzhou, Jiangsu (CN)

( * ) Notice: Subject to any disclaimer, the term of this patent is extended or adjusted under 35 U.S.C. 154(b) by 183 days.

(21) Appl. No.: 15/578,426

(22) PCT Filed: Sep. 29, 2015

(86) PCT No.: PCT/CN2015/091023
§ 371 (c)(1),
(2) Date: Nov. 30, 2017

(87) PCT Pub. No.: WO2016/192260
PCT Pub. Date: Dec. 8, 2016

(65) Prior Publication Data

US 2018/0177363 A1 Jun. 28, 2018

(30) Foreign Application Priority Data

Jun. 2, 2015 (CN) ..... 2015 1 0295844

(51) Int. Cl.
*A47L 9/10* (2006.01)
*A47L 5/24* (2006.01)
(Continued)

(52) U.S. Cl.
CPC ..... *A47L 9/102* (2013.01); *A47L 5/225* (2013.01); *A47L 5/24* (2013.01); *A47L 9/0606* (2013.01); *A47L 9/10* (2013.01); *A47L 9/2884* (2013.01)

(58) Field of Classification Search
CPC ..... A47L 9/10; A47L 9/00; A47L 5/24
See application file for complete search history.

(56) References Cited

U.S. PATENT DOCUMENTS 4,766,638 A 8/1988 McDowell
5,309,600 A * 5/1994 Weaver ..... A47L 5/00 15/323
(Continued)

FOREIGN PATENT DOCUMENTS

CN 1215581 A 5/1999
CN 1762297 A 4/2006
(Continued)

OTHER PUBLICATIONS

International Search Report for corresponding Application No. PCT/CN2015/091023; dated Mar. 9, 2016.
(Continued)

*Primary Examiner* — Michael D Jennings
(74) *Attorney, Agent, or Firm* — Cantor Colburn LLP

(57) ABSTRACT

A rod handheld two-in-one split-type vacuum cleaner having an independent dust-air separation and dust storage device is provided. A main device thereof is a handheld vacuum cleaner, and a push rod is a hollow rod. The rod handheld two-in-one split-type vacuum cleaner is provided with an independent dust-air separation and dust storage device on the push rod located above a floor brush and below the handheld vacuum cleaner. The dust-air separation and dust storage device can be independently removed to dump the dust. The main device, the push rod and the floor brush of the rod handheld two-in-one split-type vacuum cleaner can by split or assembled as different usage modes. The rod handheld two-in-one split-type vacuum cleaner can operate
(Continued)

as a floor mopping vacuum cleaner, a handheld vacuum cleaner and a handheld vacuum cleaner with a long connecting tube.

10 Claims, 5 Drawing Sheets

(51) Int. Cl.

| | |
|---|---|
| ***A47L 5/22*** | (2006.01) |
| ***A47L 9/06*** | (2006.01) |
| ***A47L 9/28*** | (2006.01) |

(56) References Cited

U.S. PATENT DOCUMENTS

| | | | | |
|---|---|---|---|---|
| 6,122,796 | A | 9/2000 | Downham et al. | |
| 7,377,007 | B2 * | 5/2008 | Best | A47L 5/225 15/329 |
| 7,882,593 | B2 * | 2/2011 | Beskow | A47L 5/225 15/347 |
| 8,069,529 | B2 * | 12/2011 | Groff | A47L 5/24 15/344 |
| 9,402,516 | B2 * | 8/2016 | Pilch | A47L 9/1691 |
| 9,427,122 | B2 * | 8/2016 | Conrad | A47L 5/225 |
| 2011/0162677 | A1 * | 7/2011 | Stein | A47L 5/225 134/21 |
| 2015/0059118 | A1 | 3/2015 | Lim et al. | |
| 2015/0059122 | A1 * | 3/2015 | Kim | A47L 5/28 15/354 |

FOREIGN PATENT DOCUMENTS

| | | | |
|---|---|---|---|
| CN | 201008537 | Y | 1/2008 |
| CN | 201814508 | U | 5/2011 |
| CN | 102133070 | A | 7/2011 |
| CN | 102499608 | A | 6/2012 |
| CN | 202604719 | U | 12/2012 |
| CN | 202739909 | U | 2/2013 |
| CN | 202776154 | U | 3/2013 |
| CN | 104840150 | A | 8/2015 |
| CN | 204698451 | U | 10/2015 |
| DE | 102008007985 | A1 | 8/2009 |
| JP | 2005270312 | A | 10/2005 |
| WO | 2014001489 | A1 | 1/2014 |

OTHER PUBLICATIONS

Extended European Search Report corresponding to Application No. 15893911.6-1018/3305154 PCT/CN2015091023; dated Jan. 17, 2019.

* cited by examiner

ROD HANDHELD TWO-IN-ONE SPLIT-TYPE VACUUM CLEANER HAVING INDEPENDENT DUST-AIR SEPARATION AND DUST STORAGE DEVICE

This is the U.S. national stage of application No. PCT/CN2015/091023, filed Sep. 29, 2015. Priority under 35 U.S.C. § 119(a) and 35 U.S.C. § 365(b) is claimed from Chinese Application No. 201510295844.8, filed Jun. 2, 2015, the disclosures of which are also incorporated herein by reference.

FIELD

The present application relates to the field of suction cleaners, and in particular to a rod handheld two-in-one separated-type suction cleaner having an independent dust-air separation and dust storage device.

BACKGROUND

Suction cleaners, as daily-use articles, are widely used for cleaning of indoors and outdoors. Conventional suction cleaners may be classified, by shape, into a horizontal suction cleaner, a vertical suction cleaner and a portable suction cleaner, and so on. The horizontal suction cleaner includes a fan which is used for generating vacuum and connected to a ground brush through components such as a hose and a long connecting tube, and etc. In cleaning, a main device is placed on the ground and can be dragged to move, and the hose is handheld by a person to clean the ground. However, such a suction cleaner has a large volume and a lot of components and is complicated to operate. Moreover, the fan is connected to the ground brush through the hose, which results in a long connection distance and a large energy loss. In the vertical suction cleaner, the ground brush is made integrally with a machine head. In use, the cleaning of the ground may just be performed by simply pushing the whole machine. This kind of suction cleaner is applicable for a large area of cleaning, and mainly facilitates the cleaning of the ground, however, it is very inconvenient for cleaning of a wall surface, a sofa, a window, a desktop and an electrical appliance, and so on. In order to make up for the above defects, a bypass hose is generally added to the machine head for connection to a variety of common hairbrushes and suction ports. This type of suction cleaner has a large volume, a high cost and is inconvenient for dust suction.

Chinese Patent CN 201110369036.3, announced on Apr. 30, 2014, discloses a vertical suction cleaner, which includes a chassis, a body, a dust collecting mechanism and a motor. The dust collecting mechanism is arranged on the body and includes a fan, a filter and a dust cup, and the dust cup is arranged on an upper end face of a main body of a fan seat. This vertical suction cleaner has a large dust collection capacity, but cannot be used in a separated mode, which causes a cleaning operation to be inconvenient.

A portable suction cleaner, for example a rod handheld separated-type suction cleaner, may be considered as a combination of a vertical suction cleaner and a handheld suction cleaner. The portable suction cleaner is more flexible in usage than the vertical suction cleaner and is used in a wider range than the handheld suction cleaner. With reference to FIG. 1, this type of suction cleaner mainly includes a ground brush, a push rod and a main device. The ground brush and the main device are connected to a front end and a back end of the push rod respectively, and the main device is detachable for being used independently as a hand-held suction cleaner, which facilitates cleaning of articles such as a wall surface, a sofa, a windowsill, a desktop and an electrical appliance. When cleaning the ground, the main device, the ground brush and the push rod may be combined to form a ground mopping suction cleaner. However, due to limitation of the space of a machine body, this kind of suction cleaner has a small main device for being portable, which causes the suction cleaner to have a small dust collecting device and a low dust collection capacity, and such a suction cleaner is not practical in a dusty place. Moreover, only one dust collecting device is provided in the handheld suction cleaner, thus, large particles of dust entering into the dust collecting device is prone to cause blockage. In addition, since only one dust collecting device is provided, it has to make the main device large in volume and large in weight, which causes inconvenience in taking and using.

Therefore, there is a demand for a separable and convenient suction cleaner that not only has an increased dust collection capacity and an additional primary filtration to prevent blockage, but also addresses issues such as the main device having a large weight and a large volume.

SUMMARY

In view of this, a rod handheld two-in-one separated-type suction cleaner is provided according to the present application. Every two of a main device, a push rod and a ground brush of the suction cleaner may be separated and assembled, and the suction cleaner has a first dust collecting device and a second dust collecting device, thus not only increasing the dust collection capacity, but also preventing blockage, and further avoiding the handheld suction cleaner to be large in weight and large in volume for handholding and the handheld suction cleaner to be detached to dump dust.

A rod handheld two-in-one separated-type suction cleaner provided according to an object of the present application includes a main device, a push rod and a ground brush. The main device is a handheld suction cleaner and the push rod is a hollow rod. Every two of the main device, the push rod and the ground brush may be separated and assembled. The rod handheld two-in-one separated-type suction cleaner further includes an independent dust-air separation and dust storage device which is detachably arranged between the ground brush and the main device. In the case that the main device, the push rod, the ground brush and the independent dust-air separation and dust storage device are used in combination, the independent dust-air separation and dust storage device forms a first dust collecting device and a built-in dust collecting device of the main device forms a second dust collecting device.

Preferably, the main device, the push rod, the ground brush and the first dust collecting device are combined, forming a ground mopping suction cleaner. An air duct of the ground brush, an air duct of the first dust collecting device and an air duct of the main device form a first integral air duct.

Preferably, the first dust collecting device includes a detachable dust collecting cup and a detachable connector. A rear portion of the ground brush is provided with a securing opening movably cooperating with a lower end of the connector. An upper end of the connector is provided with a securing opening into which one end of the push rod is inserted to be secured.

Preferably, a dust-air separation device is provided in the dust collecting cup. Initial dust air forms filtered secondary dust air after passing through the dust collecting cup, and at least a portion of dust in the initial dust air is collected in the dust collecting cup. The dust collecting cup may be taken down independently to dump dust.

Preferably, the dust collecting cup is vertically or laterally secured to the connector, and the dust collecting cup has openings which are in communication with a suction port of the main device and the connector respectively.

Preferably, the dust collecting cup is arranged on the ground brush, and the dust collecting cup has openings which are in communication with the ground brush and the connector respectively.

Preferably, a lock catch means is arranged on a rod body of the push rod and a corresponding hasp means is arranged on a machine body of the main device. The main device and the push rod are secured through the lock catch means and the hasp means.

Preferably, the main device and the push rod are combined, forming an extended-type handheld suction cleaner.

Preferably, there is an opening on each of two ends of the push rod. Each of an opening on one end of the push rod and the suction port of the main device has a mating structure, and the opening on the one end is butt-joined with the suction port of the main device. The rod body of the push rod and the air duct of the main device form a third integral air duct. An opening on the other end of the push rod forms a suction port of the third integral air duct.

Preferably, the main device may be powered by being charged or being connected to a power supply via a plug.

Compared with the conventional technology, the present application has the following advantages.

The rod handheld separated-type suction cleaner is provided with the independent dust-air separation and dust storage device, thus increasing the dust collection capacity, and enabling the dust collecting cup to be taken down independently to dump dust.

Since the independent dust-air separation and dust storage device is added, most of large particles of dust enters the independent dust-air separation and dust storage device when the dust is suctioned. The amount of dust entering into the main device is reduced, thereby preventing the main device from being blocked.

Since the independent dust-air separation and dust storage device is added, the main device may be small in volume and light in weight, facilitating the taking of the main device.

The main device, the push rod and the ground brush of the suction cleaner may be separated and assembled, and the main device may be used independently as a suction cleaner, also may be connected to a push rod for use as an extended suction cleaner.

The suction cleaner may be a chargeable suction cleaner, and may operate without a power line in use, which is more convenient.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only examples of the present application, and for the person skilled in the art, other drawings may be obtained based on the drawings without any creative efforts.

Figure 1:
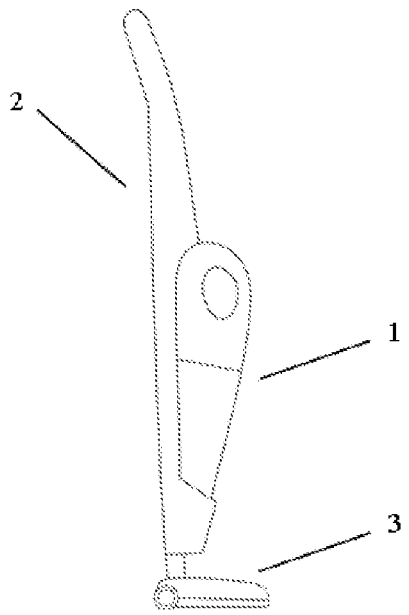
FIG. 1 is a left view of a rod handheld separated-type suction cleaner according to the conventional technology.

Explanation of reference numerals and components referred to in the drawings:

| | | | | | |
|---|---|---|---|---|---|
| 1. | main device, | 2. | push rod, | 3. | ground brush, |
| 4. | first dust collecting device, | 5. | dust collecting cup, | 6. | connector, |
| 7. | second dust collecting device, | 8. | push rod handle, | 9. | main device handle. |

DETAILED DESCRIPTION OF EMBODIMENTS

As described in the background, although the conventional horizontal or vertical suction cleaner has a large dust collection capacity, it cannot be used in a separated mode and is inconvenient to clean. The conventional rod handheld separated-type suction cleaner, though, can be used separately, has a low dust collection capacity and is prone to be blocked due to limitation of space of a machine body, besides, the main device has a large volume and weight, causing inconvenience in taking and using.

The specific technical solution of the present application is described in detail hereinafter.

Figure 2:
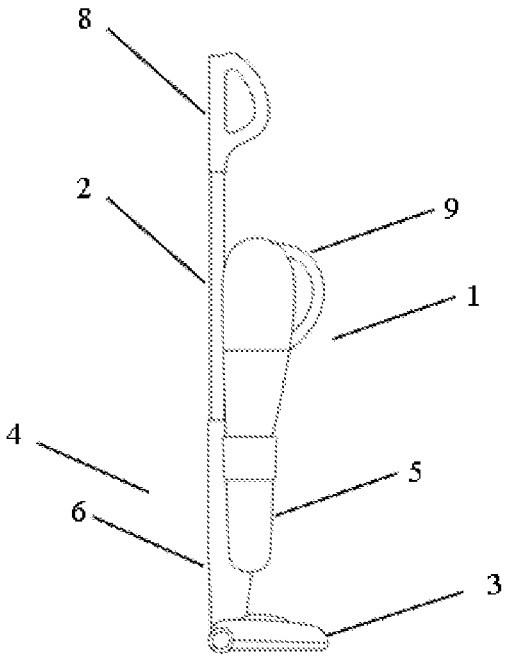
FIG. 2 is a schematic view of a rod handheld two-in-one separated-type suction cleaner having an independent dust-air separation and dust storage device according to a first embodiment of the present application.
Figure 3:
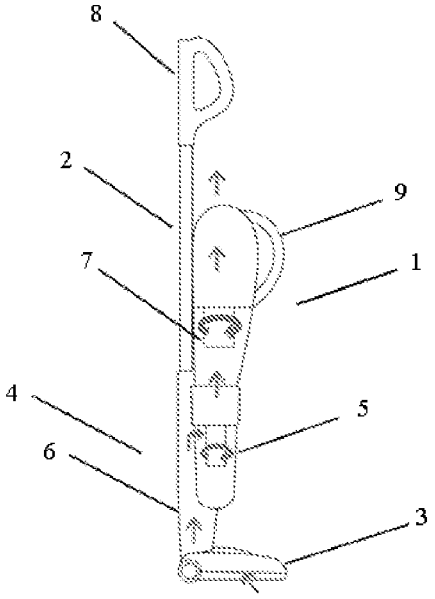
FIGS. 3 to 6 are schematic views showing flow directions of air flow when a dust collecting cup is secured in different positions according to the first embodiment of the present application.
Figure 4:
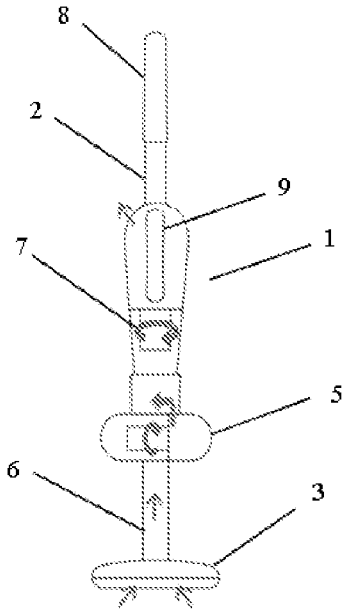
Figure 5:
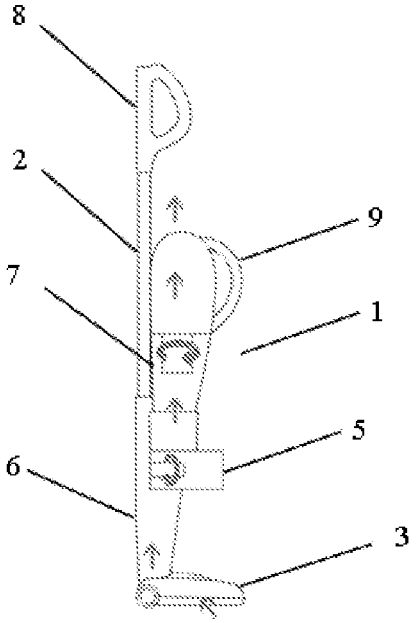
Figure 6:
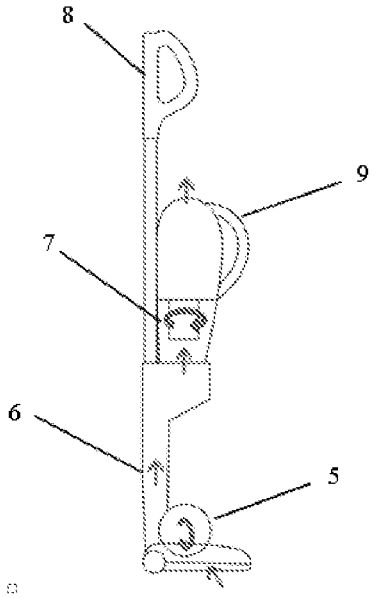

FIG. 2 shows a rod handheld two-in-one separated-type suction cleaner having an independent dust-air separation and dust storage device according to a first embodiment of the present application. The suction cleaner includes a main device 1, a push rod 2 and a ground brush 3. The main device 1 is a handheld suction cleaner and the push rod 2 is a hollow rod. Every two of the main device 1, the push rod 2 and the ground brush 3 may be separated and assembled. The rod handheld separated-type suction cleaner further includes a first dust collecting device 4, that is, an independent dust-air separation and dust storage device. The first dust collecting device 4 includes a dust collecting cup 5 and a connector 6, both of which may be detachably arranged between the ground brush and the main device. A built-in dust collecting device of the main device 1 forms a second dust collecting device 7. A rear portion of the ground brush is provided with a securing opening movably cooperating with a lower end of the connector 6 of the first dust collecting device. An upper end of the connector 6 is provided with a securing opening into which a front end of the push rod 2 is inserted to be secured, thereby the main device 1, the push rod 2, the ground brush 3 and the first dust collecting device may be used in combination to form a ground mopping suction cleaner.

A distal end of the push rod 2 is provided with a push rod handle 8, and the push rod handle 8 is provided with a first power supply switch (not illustrated in the figure) which controls on and off of the ground mopping suction cleaner according to this embodiment.

Reference is made to FIGS. 3 to 6, which are schematic views showing flow directions of air flow in the case that the dust collecting cup 5 is secured in different positions according to the first embodiment of the present application, and directions of arrows in the figures indicate the flow directions of the air flow in an air duct. The first dust collecting device 4 may be detachably secured to the ground brush 3 at any position and by any form, and the first dust collecting device 4 is provided with a channel in communication with the ground brush 3. For example, in FIG. 3, the dust collecting cup 5 is vertically secured to the connector 6, and there is a first opening in communication with the connector 6 at a side of the dust collecting cup 5 and a second opening in connection with a suction port of the main device 1 and communicating with the suction port at an upper end of the dust collecting cup 5. As another example in FIG. 4, the dust collecting cup 5 rotates by 90 degrees to be laterally secured to the connector 6, and there are openings on both of an upper side and a lower side of the dust collecting cup 5, which are in communication with the connector 6 and the suction port of the main device 1 respectively, and the suction port of the main device 1 is inserted into a corresponding opening of the dust collecting cup 5 and communicates with it. As a further example in FIG. 5, the dust collecting cup 5 is in a lateral direction, and there is a first opening in communication with the connector 6 in a left side of the dust collecting cup 5 and a second opening in connection and communication with the suction port of the main device 1 in an upper side of the dust collecting cup 5. As a yet further example in FIG. 6, the dust collecting cup 5 is directly secured to the ground brush 3 and is provided with two openings which are in communication with the ground brush 3 and the connector 6 respectively, and in this case the suction port of the main device is in communication with the connector 6. An air duct of the ground brush 3, an air duct of the first dust collecting device 4 and an air duct of the main device 1 form a first integral air duct in the above several securing manners according to this embodiment.

Also, the first dust collecting device 4 may alternatively include only a dust collecting cup 5 with the connector dispensed, that is, the dust collecting cup 5 is directly attached to the push rod 2 in any form. Moreover, the dust collecting cup 5 is provided with two openings which are in communication with the push rod 2 and the main device 1 respectively. Alternatively, the dust collecting cup 5 is directly secured to the ground brush 3 and is provided with openings which are in communication with the ground brush 3 and the push rod 2 respectively, while the suction port of the main device is in communication with the push rod, thereby the air duct of the ground brush 3, an air duct of the push rod 2, an air duct of the dust collecting cup 5 and the air duct of the main device 1 form an integral air duct. Because the connector is dispensed, the ground mopping suction cleaner can have a small volume and a light weight and be more convenient. According to this embodiment, the dust collecting cup 5 in each example may be taken down independently to dump dust.

A dust-air separation device is arranged in each of the first dust collecting device 4 and the second dust collecting device 7. After initial dust air passing through the first dust collecting device 4, filtered secondary dust air is formed, and at least a portion of dust in the initial dust air is collected in the first dust collecting device 4, specifically, in the dust collecting cup 5. Thereafter, secondary dust air enters the second dust collecting device 7 for being filtered. Specifically, each of the first dust collecting cup 5 and the second dust collecting device 7 includes two portions—a front portion and a back portion, which are connected by a snap-fit manner to form a sealed space for storing suctioned dust. Each of the dust collecting cup 5 and the second dust collecting device 7 is provided with a dust collecting device separation button to separate the front portion and the back portion of the corresponding dust collecting devices. The front portion and the back portion of a dust collecting device may be separated from each other to remove dust within the dust collecting device in the case that its separation button is pressed.

The main device 1 as a whole is attached to the push rod 2, that is, a lock catch means is provided on a rod body of the push rod 2 and a corresponding hasp means is provided on the body of the main device. The main device and the push rod are secured through the lock catch means and the hasp means. Specifically, the lock catch means and the hasp means can be released and locked by providing an unlocking button for controlling the installation and separation of the main device and the push rod.

A bottom of the ground brush 3 is provided with a roller. When an operation mode of the suction cleaner is a ground mopping mode according to the first embodiment, the ground brush sucks dust. In this case, the ground mopping type dust suction may just be performed by simply gripping a handle at the distal end of the handheld push rod 2.

Figure 7:
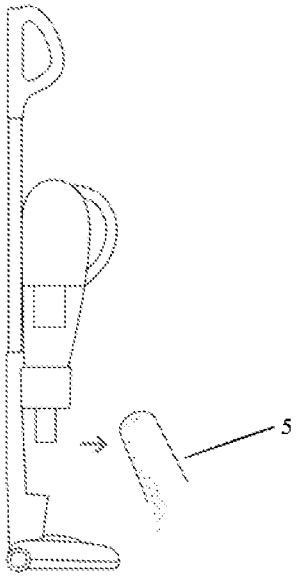
FIG. 7 is a schematic view showing a dust collecting cup, which is taken down independently to dump dust, according to the first embodiment of the present application.

With reference to FIG. 7, FIG. 7 is a schematic view showing the dust collecting cup 5, which is taken down independently to dump the dust, according to the first embodiment of the present application. In this embodiment, the dust is sucked by the ground brush 3, and the dust passes through the first dust collecting device 4 and the second collection device 7 in the listed sequence. Since the first dust collecting device 4 is added, that is, a primary filtration is added and the dust collecting cup 5 may filter the dust independently and dump the dust independently, the main device 1 can be cleaned without being removed from the suction cleaner. After the primary filtration, remaining dust enters the second dust collecting device 7 in the main device 1 for being the secondarily filtered. Since a vast majority of large particles of dust is filtered in the primary filtration, it is difficult for a minor portion of remaining small particles of dust to cause the main device 1 to be blocked during the secondary filtration.

Figure 8:
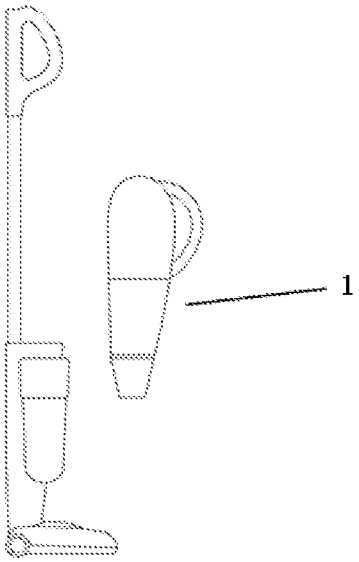
FIG. 8 is a schematic view showing a state of each of a main device and a first dust collecting device, in the case that the main device is used independently as a suction cleaner, according to a second embodiment of the present application.

With reference to FIG. 8, FIG. 8 is a schematic view showing a state in which the main device is detached from the first dust collecting device and the main device is used independently as a suction cleaner according to the present application. The main device 1 further includes a main device handle 9 for facilitating the taking of the main device. The main device 1 may be taken down independently to be used as an independent suction cleaner. The handle 9 of the main device 1 is provided with a second power supply switch (not shown in the figure) which may control on and off of the handheld suction cleaner according to this embodiment. The suction port of the main device is used for sucking dust, and a suction head may have a circular shape, a flat shape or other shapes suitable for dust suction. If the suction cleaner is required to clean articles such as a wall surface, a sofa, a windowsill, a desktop and an electrical appliance, the main device 1 is separated from the first dust collecting device 4 and the push rod 2, and the main device handle 9 is held and the second power supply switch is turned on. In this case, the air duct of the main device forms a second integral air duct, and air flow flows through the second dust collecting device 7, thus completing filtration.

Figure 9:
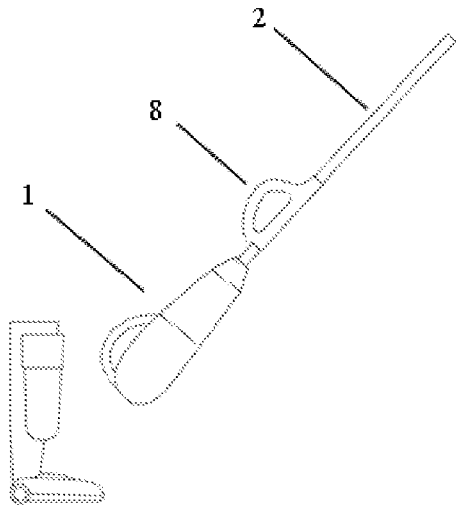
FIG. 9 is a schematic view showing a three-dimensional structure of an extended-type handheld suction cleaner according to a third embodiment of the present application in use.

With reference to FIG. 9, FIG. 9 is a schematic view showing a three-dimensional structure of an extended-type handheld suction cleaner according a third embodiment of the present application in an operating state. In this embodiment, the main device 1 and the push rod 2 are independently taken down respectively, and are assembled together. The push rod 2 is a hollow rod. There is an opening on each of two ends of the push rod 2, and the opening on one end of the push rod 2 and the suction port of the main device 1 have mating structures. In the case that the main device is connected to the push rod for being used as a suction cleaner according to the third embodiment of the rod handheld separated-type suction cleaner, the opening on the one end is butt-joined with the suction port of the main device 1, the rod body of the push rod 2 and the air duct of the main device form a third integral air duct, and the opening on the other end of the push rod 2 forms a suction port of the third integral air duct. Further, a push rod handle 8 is provided in proximity to one end of the push rod 2, the opening on the end where the push rod handle is arranged is butt-joined with the suction port of the main device. The push rod 2 may be designed as a telescopic rod, may be adjusted in length as desired for long distance dust suction, thereby forming an extended-type handheld suction cleaner which can suck objects at a long distance, such as on a ceiling.

In the present application, the main device is powered by being charged or being connected to a power supply via a plug, preferably the main device is powered by a built-in battery. The built-in battery is located at a bottom of the main device. In the case that the main device is mounted on the push rod, the built-in battery is attached to a side of the push rod. Thereby, the suction cleaner can operate without a power line in an operating state, which may be more convenient.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to these embodiments illustrated herein, but should be defined by the broadest scope consistent with the principle and novel features disclosed herein.

The invention claimed is:

1. A rod handheld two-in-one separated-type suction cleaner, comprising:

a main device, a push rod, and a ground brush, wherein the main device is a handheld suction cleaner and the push rod is a hollow rod, every two of the main device, the push rod and the ground brush are detachably assembled, wherein the rod handheld two-in-one separated-type suction cleaner further comprises an independent dust-air separation and dust storage device, which is detachably arranged between the ground brush and the main device, and in the case that the main device, the rod, the ground brush and the independent dust-air separation and dust storage device are used in combination, the independent dust-air separation and dust storage device forms a first dust collecting device and a built-in dust collecting device of the main device forms a second dust collecting device, wherein a dust-air separation device is provided in the first dust collecting device, and after initial dust air passing through the first dust collecting device, a filtered secondary dust air is formed, and at least a portion of dust in the initial dust air is collected in the first dust collecting device.

2. The rod handheld two-in-one separated-type suction cleaner according to claim 1, wherein the first dust collecting device comprises a detachable dust collecting cup and a detachable connector, and a rear portion of the ground brush is provided with a securing opening movably cooperating with a lower end of the connector, and an upper end of the connector is provided with a securing opening into which one end of the push rod is inserted to be secured.

3. The rod handheld two-in-one separated-type suction cleaner according to claim 2, wherein the dust collecting cup is vertically or transversely secured to the connector in a detachable manner, and the dust collecting cup has openings which are in communication with a suction port of the main device and the connector respectively.

4. The rod handheld two-in-one separated-type suction cleaner according to claim 2, wherein the dust collecting cup is detachably arranged on the ground brush and has openings which are in communication with the ground brush and the connector respectively, and in this case, a suction port of the main device is in communication with the connector.

5. The rod handheld two-in-one separated-type suction cleaner according to claim 1, wherein the first dust collecting device comprises only a dust collecting cup, the dust collecting cup is detachably attached to the push rod, and the dust collecting cup has openings which are in communication with the push rod and the main device respectively, thereby an air duct of the ground brush, an air duct of the push rod, an air duct of the dust collecting cup and an air duct of the main device form an integral air duct.

6. The rod handheld two-in-one separated-type suction cleaner according to claim 1, wherein the first dust collecting device comprises only a dust collecting cup, the dust collecting cup is detachably arranged on the ground brush, and the dust collecting cup has openings which are in communication with the ground brush and the push rod respectively, and in this case, a suction port of the main device is in communication with the push rod, thereby an air duct of the ground brush, an air duct of the dust collecting cup, an air duct of the push rod and an air duct of the main device form an integral air duct.

7. The rod handheld two-in-one separated-type suction cleaner according to claim 1, wherein a lock catch means is provided on a rod body of the push rod and a corresponding hasp means is arranged on a body of the main device, and the main device and the push rod are secured through the lock catch means and the hasp means.

8. The rod handheld two-in-one separated-type suction cleaner according to claim 1, wherein the main device and the push rod are combined, forming a handheld suction cleaner with a long connecting pipe.

9. The rod handheld two-in-one separated-type suction cleaner according to claim 7, wherein there is an opening on each of two ends of the push rod, and the opening on one end of the push rod and a suction port of the main device have mating structures, and the opening on the one end is butt-joined with the suction port of the main device, and the rod body of the push rod and the air duct of the main device form a third integral air duct, and the opening on the other end of the push rod forms a suction port of the third integral air duct.

10. The rod handheld two-in-one separated-type suction cleaner according to claim 1, wherein the main device is powered by being charged or is connected to a power supply via a plug.

* * * * *